United States Patent [19]

Steinhilber

[11] 4,186,861

[45] Feb. 5, 1980

[54] WIRE ACCUMULATOR TOWER

[75] Inventor: Wilhelm A. Steinhilber, Guilford, Conn.

[73] Assignee: Orion Machinery and Engineering Corporation, Branford, Conn.

[21] Appl. No.: 930,698

[22] Filed: Aug. 3, 1978

[51] Int. Cl.[2] ..... B65H 17/42

[52] U.S. Cl. ..... 226/118; 226/119; 242/55.01

[58] Field of Search ..... 226/118, 119, 189; 242/47.5, 55.01, 55.17

[56] References Cited

U.S. PATENT DOCUMENTS

| | | | |
|---|---|---|---|
| 3,414,208 | 12/1968 | Butler | 242/55.01 X |
| 3,669,375 | 6/1972 | Bruton | 226/189 |
| 3,796,360 | 3/1974 | Alexeff | 226/119 |
| 4,058,265 | 11/1977 | Hedland | 226/118 X |

FOREIGN PATENT DOCUMENTS

| | | | |
|---|---|---|---|
| 1289781 | 5/1961 | France | 226/118 |

*Primary Examiner*—Edward J. McCarthy
*Attorney, Agent, or Firm*—McCormick, Paulding & Huber

[57] ABSTRACT

A machine for processing a continuous strand of wire includes a wire accumulator tower which has a double capstan for advancing the strand, a festoon assembly for accumulating a supply of wire, and a pay-off/take-up spool mechanism which includes means for positioning a spool relative to an output shaft, and a manually operated dog clutch for drivingly engaging the spool with the output shaft. The capstans, the festoon assembly, and the spool mechanism are arranged in vertical relationship to each other on an upright frame. The accumulator tower may be operated in either a wire pay-off or take-up mode.

15 Claims, 8 Drawing Figures

FIG. 4
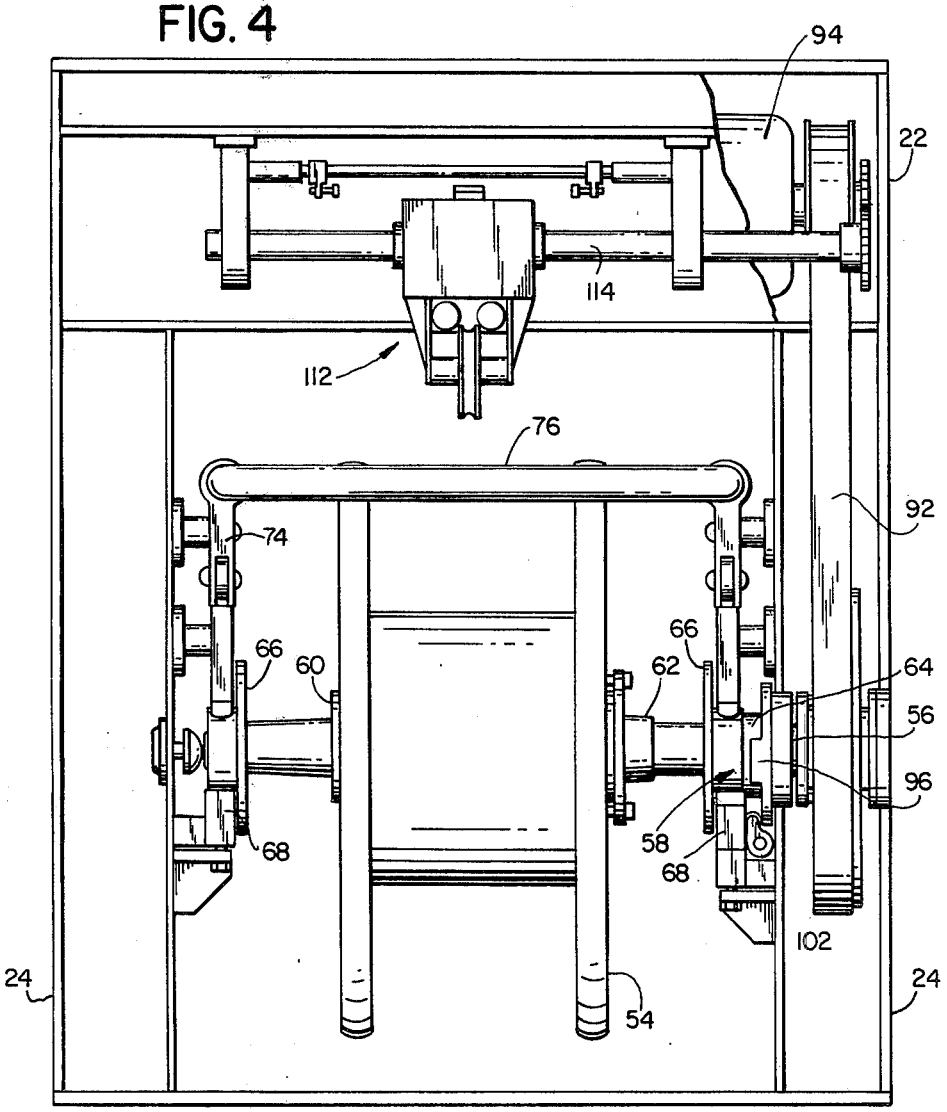
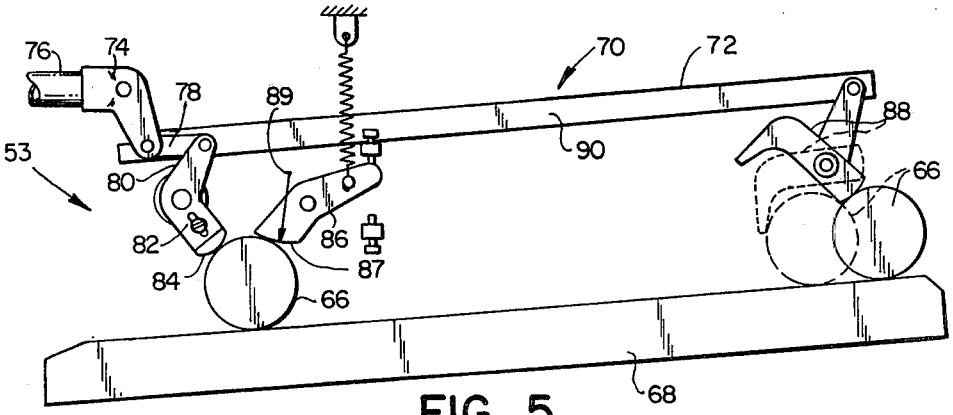
FIG. 5

WIRE ACCUMULATOR TOWER

BACKGROUND OF THE INVENTION

This invention relates in general to wire processing apparatus and deals more particularly with an improved wire accumulator tower particularly adapted for use in a machine for processing a continuous strand of wire. Many wire processing operations require that wire move continuously through processing equipment at a relatively constant rate to assure uniform processing. In a process for annealing wire, for example, it is essential that the wire to be processed move continuously through the annealing furnace at a constant rate to assure uniform heat treating. Since wire is usually supplied to such processing equipment from a pay-off spool, some arrangement must be provided to temporarily supply wire to and receive wire from the processing equipment during spool changes, so that such spool changes may be accomplished without shutting down the processing equipment. The present invention is concerned with improvements in apparatus of the aforedescribed general type.

SUMMARY OF THE INVENTION

In accordance with the present invention a wire accumulator tower comprises a vertically elongated frame, a pair of capstans supported for rotation on the frame to receive portions of a strand wire looped therearound. The capstans include a first capstan supported for rotation about a horizontal axis and a second capstan supported above the first capstan for rotation about an axis parallel to and vertically spaced from the axis of the first capstan. The capstans are driven in timed relation to each other. The apparatus further includes a festoon assembly which has a first and second set of sheaves. The sheaves in each set are supported on the frame for coaxially free rotation relative to each other. The first set of sheaves is supported for rotation about an axis below and generally parallel to the axes of the capstans. The second set is supported on the frame above the first set. One of the sets is arranged for vertical movement relative to frame and toward and away from the other of the set. The apparatus may also include a pay-off/take-up spool assembly which includes means for receiving and positioning a spool in driving relation with an output shaft and a manually operated dog clutch for establishing driving connection between the spool and the output shaft.

BRIEF DESCRIPTION OF THE DRAWINGS

FIG. 4 is a somewhat enlarged fragmentary front elevational view of the apparatus shown in FIG. 1.

FIG. 5 is a somewhat schematic side elevational view of the spool positioning, receiving and retaining mechanism.

DETAILED DESCRIPTION OF PREFERRED EMBODIMENT

Figure 1:
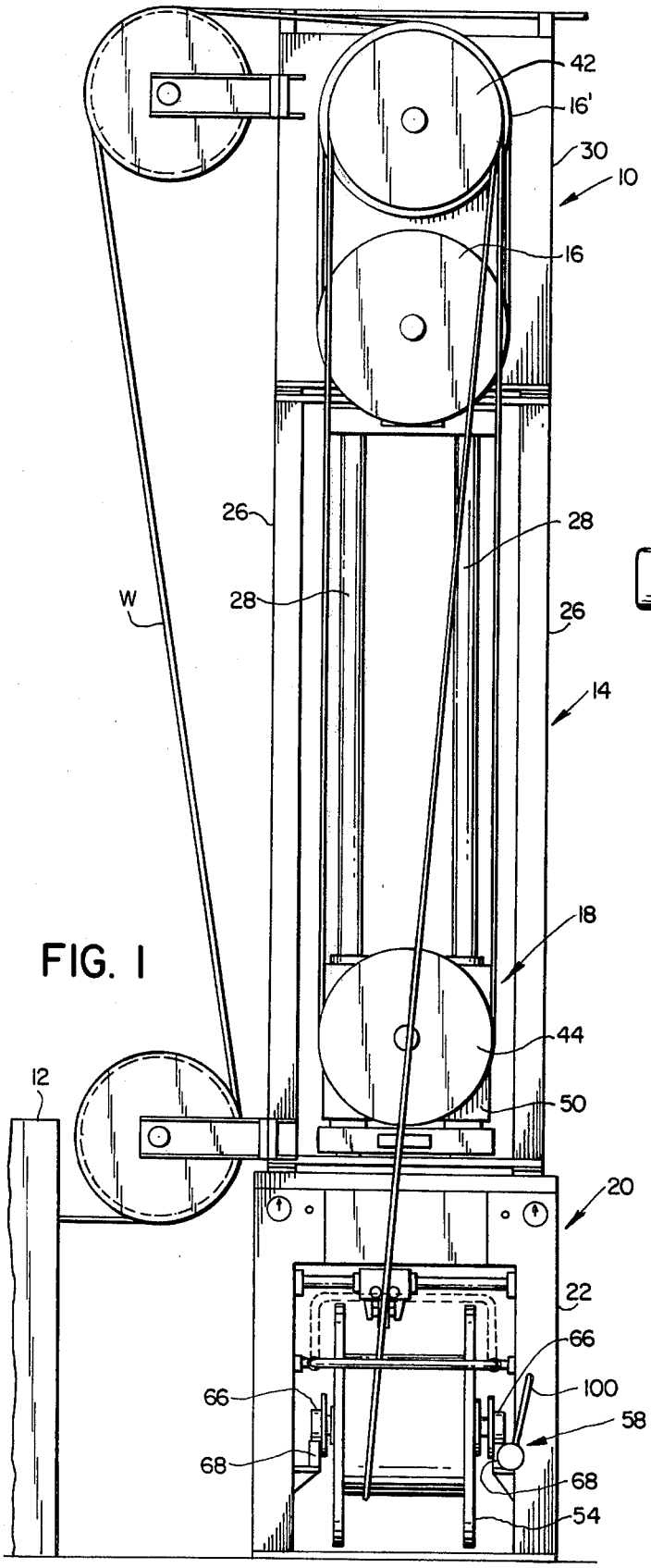
FIG. 1 is a front elevational view of a wire feeding and accumulating apparatus embodying the present invention and which comprises a part of a wire processing machine.
Figure 2:
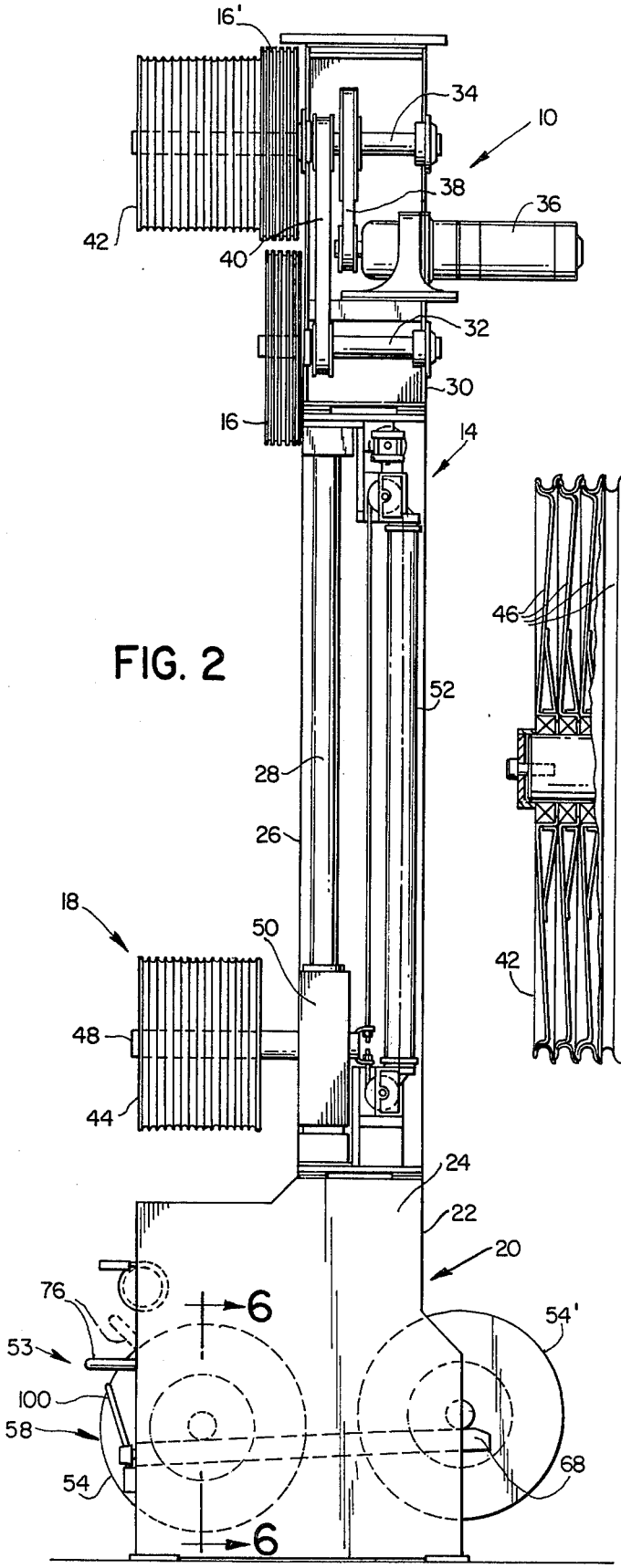
FIG. 2 is a side elevational view of the machine of FIG. 1 shown partially in vertical section.

Turning now to the drawings, and referring first particularly to FIGS. 1 and 2, a wire accumulator tower embodying the present invention and indicated generally by the reference numeral 10 comprises a part of an apparatus for processing a continuous strand of wire W. The illustrated tower 10 may be arranged to either pay-off or take-up wire but, as illustrated, the tower 10 is arranged to pay-off a continuous strand of wire W and feed it into an annealing furnace 12 which comprises a part of the processing apparatus. Another accumulator tower similar to the tower 10, but not shown, may be located at the discharge end of the furnace 12 to function as a take-up mechanism for receiving wire W from the furnace 12.

The illustrated apparatus 10 generally comprises a vertically elongated frame, indicated generally at 14, which supports a pair of capstans designated by the numerals 16, 16' and festoon assembly indicated generally at 18. The apparatus further includes a take-up/pay-off spool mechanism indicated generally at 20. However, since the mechanism 20, as shown, is arranged to operate in a pay-off mode for convenience of description, it will be hereinafter referred to as the pay-off spool mechanism. The capstans 16, 16' the festoon assembly 18 and the pay-off spool mechanism 20 are arranged in vertical relation to each other on the frame 14, substantially as shown.

Considering now the apparatus 10 in further detail, the frame 14 has a base 22 which includes hollow sidewalls 24, 24 and which has openings at its opposite ends. A pair of elongated structural members 26, 26 and a pair of transversely spaced guide rods 28, 28 which extend upwardly from the base 22, form an intermediate part of the frame. A generally rectangular box shaped upper part 30 is supported by and above the intermediate part.

Each capstan 16, 16' is generally cylindrical and has a series of coaxial annular wire receiving grooves 31, 31 which open to its peripheral surface. The cross sectional area of each groove is preferably substantially greater than the cross sectional area of the largest wire to be received therein. Each of the illustrated capstans is provided with five such grooves, however, the number of grooves may vary. The lower capstan 16 is keyed to a shaft 32 journaled on the frame upper part 30 for rotation about a horizontal axis. The upper capstan 16' is keyed to another shaft 34 also journaled on the frame upper part 30 for rotation about an axis parallel to and vertically spaced from the axis of the lower capstan 16. A direct current motor 36 connected by a timing belt 38 to the upper shaft 34 drives the upper capstan 16', as best shown in FIG. 2. The lower capstan 16 is driven in timed relation with the upper capstan by another timing belt 40 connected between the shafts 32 and 34.

Figure 3:
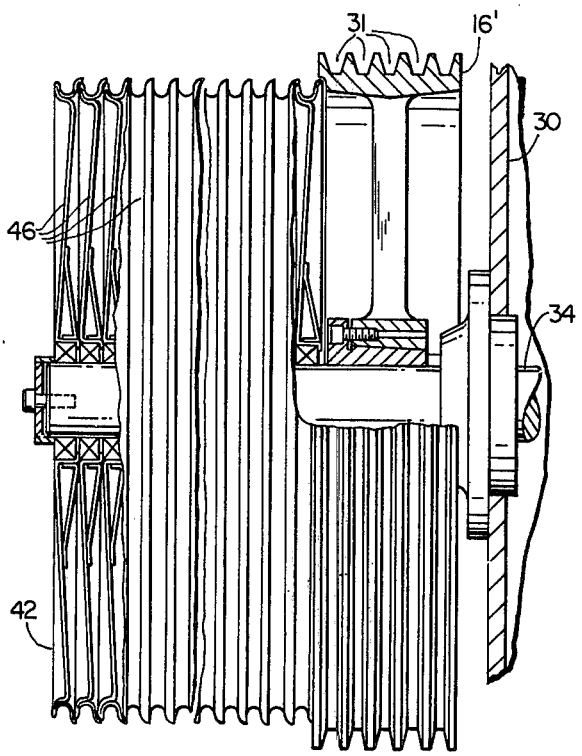
FIG. 3 is a somewhat enlarged fragmentary side elevational view of the upper capstan and the upper sheaves, parts of the capstan and sheaves being shown broken away to reveal details of the structure.

The festoon assembly 18 includes a set of upper sheaves 42 and a set of lower sheaves 44. Each set includes a plurality of individual sheaves 46, 46 supported on a shaft for coaxial free rotation relative to each other. The sheaves 46, 46 which comprise the upper set are journaled adjacent the upper capstan 16' on an extending portion of the shaft 34. Each sheave 46 is supported by an individual ball bearing race carried by the shaft 34, as best shown in FIG. 3. The lower set 44 is supported in like manner below the upper set 42 and for coaxial free rotation relative to each other on a shaft 48 carried by a slide 50 slidably supported on the guide rods 28, 28. Thus, the lower set 44 is journaled for rotation about an axis parallel to the axes of the capstans 16, 16', and is further supported for vertical movement relative to the frame and generally toward and away from the upper set 42. A counter balancing mechansim (not shown) is provided for counter balancing the lower set 44 for smooth vertical movement relative to the frame and the upper set 42. A double acting air motor 52 is connected by pulleys and cables to the slide 50, substantially as shown in FIG. 2. Referring to FIG. 1 it will be noted that the axes of the capstans 16, 16 and the upper and lower sets 42 and 44 are disposed generally within a common vertical plane.

Referring now particularly to FIGS. 4 and 5 the pay-off spool mechanism 20 includes an apparatus for receiving and accurately positioning and retaining a spool, indicated at 54, in coaxially alignment with an output shaft 56. The mechanism 20 further includes a manually operated clutch mechanism indicated generally at 58 for drivingly engaging the spool 54 with the output shaft 56. Each spool 54 has an axle shaft which extends coaxially therethrough and which is fitted with adaptor flanges 60 and 62 at its opposite ends. The adaptor 62 is formed with a clutch part 64 at its outer end. Each shaft adaptor 60 and 62 also has flange 66 journaled at its out end for free rotation relative to its associated adaptor.

The spool receiving positioning and retaining mechanism, indicated at 53, includes a pair of rails 68, 68 located within and extending from the front to the rear of the base 22. Each rail 68 is mounted on and inwardly of an associated side wall 24 and is downwardly and forwardly inclined, as shown in FIG. 2, but preferably not more than $2\frac{1}{2}°$. The rails 68, 68 are transversely spaced to receive and engage the flanges 66, 66 on an associated spool 54. The positioning mechanism 53 further includes a handle operated link mechanism which is operative to receive and retain one spool in a ready position on the rails 68, 68 and at the rear of the base, and to release another previously positioned spool from the ready position and accurately position and retain it in a drive position in alignment with the output shaft 56. In FIG. 2 one spool 54' is shown in a ready position and another spool 54 is shown in a drive position.

The spool receiving positioning and retaining mechanism 53 includes a link mechanism indicated generally at 70 in FIG. 5 which comprises two sets of linkages 72, 72 located within the base 22 at opposite sides thereof for engaging the flanges 66, 66 on an associated spool 54. A typical linkage 72, shown in FIG. 5, includes a crank 74 journaled on an associated side wall 24 and connected to one end of a handle or crossbar 76. Each crank is connected by a link 78 to another crank 80 which has a stop member 82 mounted thereon for engaging an associated flange 66. The stop member carries a spool stop cam 84 which is radially adjustable relative to the crank 80 by means of a fastener and a slot, such as shown in FIG. 5. The positioning apparatus further includes a pair of spring loaded positioning cams 86 (one shown) which are mounted at opposite sides of the base for respectively engaging the flanges 66, 66. Each cam 86 has an arcuate clamping surface 87 which has a center of curvature 89 eccentric to the pivotal center of the cam to provide positive clamping action. A pair of positioning latches 88, 88 (one shown) are located inwardly of the base 22 at opposite sides thereof for engaging the flanges on another spool 54'. Each positioning latch is connected to an associated crank 74 by a link 90 substantially as shown in FIG. 5.

Figure 7:
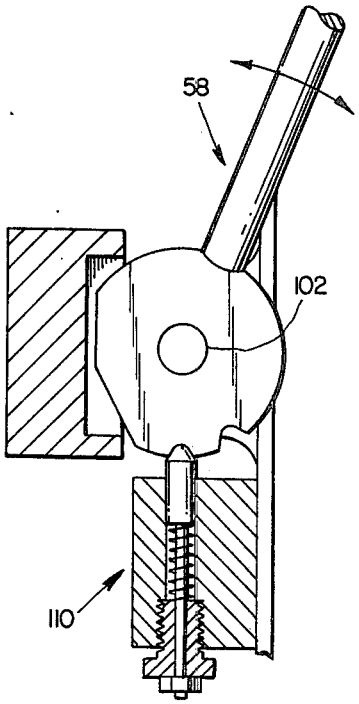
FIG. 7 is a somewhat enlarged fragmentary elevational view of the clutch lever and detent mechanism shown partially in vertical section.
Figure 6:
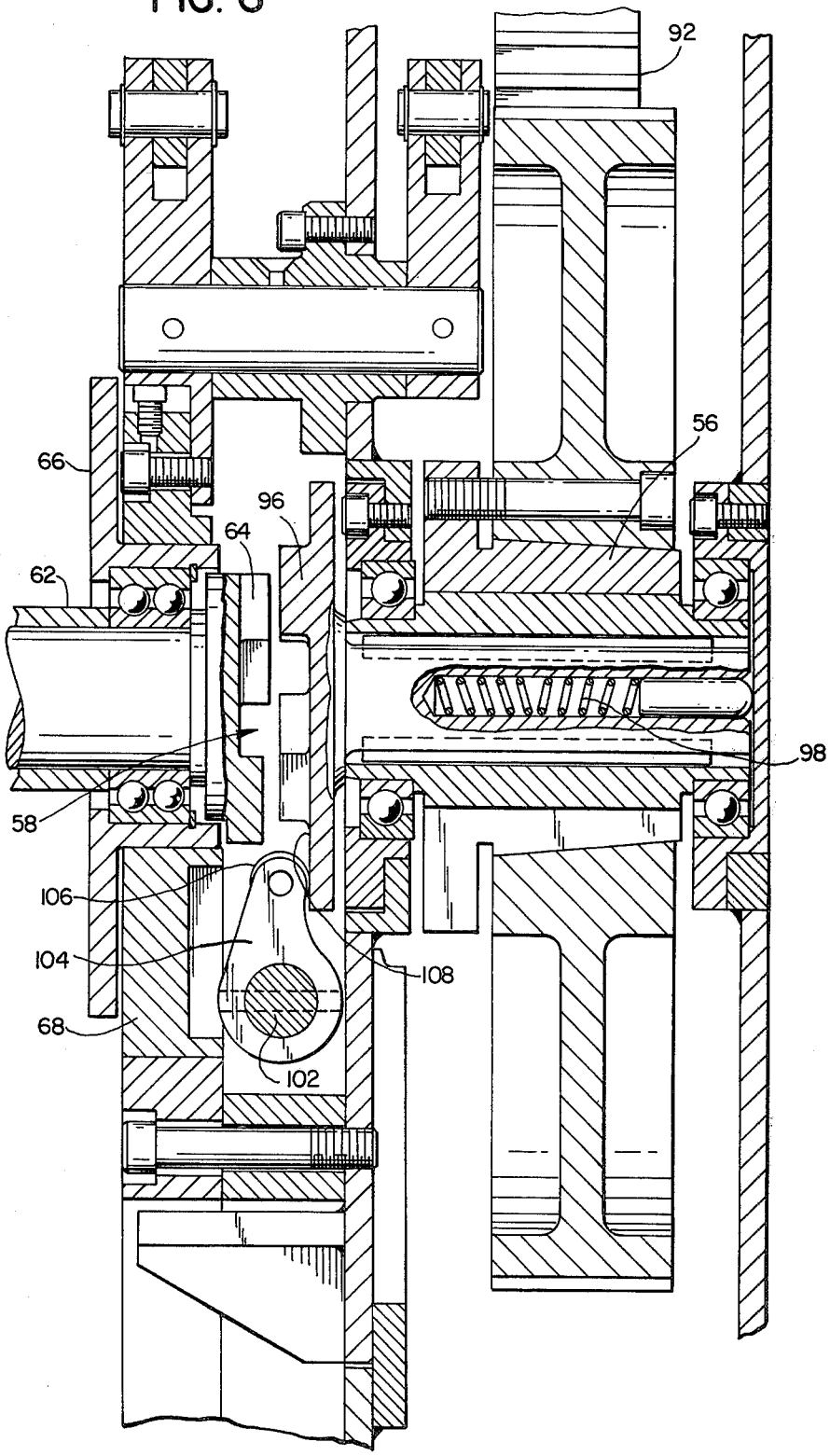
FIG. 6 is a fragmentary sectional view taken generally along the lines 6—6 of FIG. 2.

The output shaft 56 is driven by a timing belt 92 connected to a D.C. motor 94 mounted in the base 22. A spring loaded clutch part 96 associated with the output shaft 56 and drivingly engaged therewith is normally biased toward a condition of interlocking engagement with the clutch part 64 by a clutch spring 98, as shown in FIG. 6. The clutch is operated by a clutch lever 100 located at the front end of machine and mounted on one end of a rearwardly extending clutch rod 102 which is journaled on one of the sidewalls 24. A clutch cam assembly 104 mounted on the other end of the rod 102 carries a roller follower 106 for engaging a flange 108 on the inner side of the clutch part 96 when the clutch lever 100 is rotated in a clockwise direction from its position in FIGS. 1 and 7. The clutch cam assembly 104 urges the clutch part 96 outwardly to a disengaged position relative to the clutch part 64 against the biasing force of the clutch spring 98. A spring detent mechanism indicated generally at 110 and shown in FIG. 7 releasably retains the clutch lever in either of two positions corresponding to engaged and disengaged clutch conditions.

The spool mechanism 20 also includes a traversing device indicated generally at 112 for controlling the lay of a wire strand on the spool when the apparatus 10 is used for spooling wire. The traversing mechanism 112 is of a well known, commercially available type and includes ball mechanism for engagement with a smooth rotating shaft 114 which is driven by the motor 94 and in timed relation with the spool 54.

As previously noted the apparatus 10 is particularly adapted to pay-off a continuous strand of wire W. When a spool runs out the free end of the wire is clamped or otherwise secured by means (not shown). Thereafter, the capstans 16, 16' continue to receive wire from the festoon assembly 18. The empty spool is released by raising the handle 76 which allows the empty spool to roll down the inclined rails 68, 68 in and out of the front end of the machine. Raising the handle allows another spool which is in the ready or full line position shown in FIG. 5 to move to its broken line position of FIG. 5 wherein it is held by the positioning latches 88, 88 which have the capabilitity of holding the spool in either of two positions indicated by full and broken lines in FIG. 5. When the handle 76 is again lowered the spool at the ready position is released by the hooked ends of the latches 88, 88 and rolls down the inclined rails 68, 68 past the spring loaded positioning cams 86, 86 to a position in alignment with the output shaft 56 wherein the flanges 66, 66 are arrested by engagement with the stop cams 84, 84. The end of the new spool may then be knotted or otherwise secured to the free end of the strand W which is clamped, as previously noted.

Figure 8:
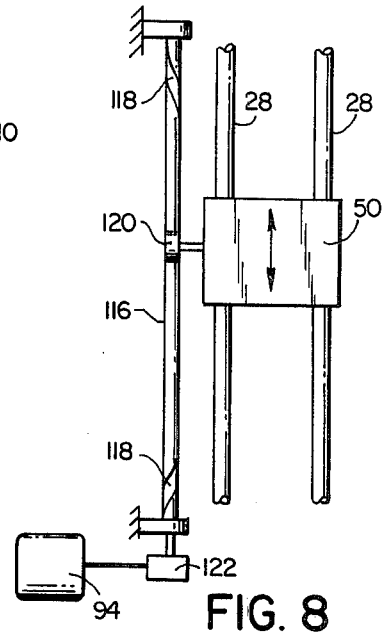
FIG. 8 is a somewhat schematic elevational view of a part of the festoon assembly.

While the spool is being changed wire is continuously fed from the festoon assembly 18 which causes the lower set of sheaves 44 to move upwardly. Tension on the wire within the festoon assembly 18 may be adjusted by adjusting the air motor 52. The supply of wire in the festoon is sufficient to allow adequate time to accomplish the spool change. After the end of the runout spool has been connected to the new spool the clamped end of the strand W is released. Thereafter, wire is again accumulated in the festoon assembly 18. A sensing device is provided for over speeding the pay-off spool to allow wire to accumulate in the festoon assembly. In the present apparatus the sensing device shown in FIG. 8 comprises an elongated rod 116 which has spiral portions 118, 118 and a follower 120 which travels with the lower set of sheaves 44. Engagement of the follower 120 with one of the spiral end portions of the rod causes the rod 116 to twist and operate a potentiometer 122 associated therewith which controls the speed of the DC motor 94.

I claim:

1. In a machine for processing a continuous strand of wire the combination comprising a vertically elongated frame, a pair of capstans supported for rotation on said frame for receiving portions of the strand looped therearound and including a first capstan supported for rotation about a horizontal axis and a second capstan supported above said first capstan for rotation about an axis parallel to and vertically spaced from the axis of said first capstan, means for driving said capstans in timed relation to each other, and a festoon assembly for accumulating and storing a portion of the strand and including a first set of sheaves supported on said frame for coaxial free rotation relative to each other about an axis below and parallel to the axes of said capstans and a second set of sheaves supported on said frame above said first set and journalled for coaxial free rotation relative to each other and to said capstans, one of said sets being supported for vertical movement relative to said frame and toward and away from the other of said sets.

2. The combination as set forth in claim 1 wherein the axes of said capstans and the axes of said sheaves are disposed in a common vertical plane.

3. The combination as set forth in either claim 1 or claim 2 wherein said second set of sheaves is disposed generally adjacent said second capstan and journalled for coaxial rotation relative to said second capstan.

4. The combination as set forth in claim 3 wherein said first set of sheaves is supported for vertical movement relative to said frame and generally toward and away from said second set of sheaves.

5. The combination as set forth in claim 4 wherein said frame includes a pair of transversely spaced vertically extending guide rods and a slide supported for vertical sliding movement on said rods and said first set of sheaves is supported on said slide.

6. The combination as set forth in claim 1 wherein said driving means includes a drive motor drivingly connected to one of said capstans and a timing belt for driving the other of said capstans in timed relation to said one capstan.

7. The combination as set forth in claim 1 including a wire pay-off/take-up mechanism supported on said frame below said capstans and said festoon assembly for receiving and supporting a wire spool, a spool drive unit having an output shaft, means for positioning and retaining the spool in coaxial alignment with said output shaft, and a clutch for drivingly connecting the spool to said output shaft.

8. The combination as set forth in claim 7 wherein said frame includes a base portion, an upper portion, and a intermediate portion including a pair of transversely spaced guide rods connected to and vertically extending between said base portion and said upper portion and a slide supported on said guide rods for vertical sliding movement, said capstans and said second set of sheaves being supported on said upper portion, said first set of sheaves being supported on said slide, said wire pay-off/take-up mechanism being supported in said base.

9. The combination as set forth in claim 7 wherein said clutch comprises a dog clutch normally biased toward a position of driving engagement and which includes a manually operated clutch lever for moving said clutch to a position of disengagement and detent means for releasably retaining said clutch in its disengaged position.

10. The combination as set forth in claim 1 wherein each of said capstans is generally cylindrical and has a series of coaxial annular wire receiving grooves opening through its peripheral surface.

11. The combination as set forth in claim 10 wherein each of said capstans has at least five wire receiving grooves therein.

12. In a machine for processing wire a take-up/pay-off spool mechanism for a spool having a coaxial spool shaft and comprising an output shaft, means for receiving positioning and retaining the spool with the spool shaft coaxially aligned with the output shaft, and a manually operated dog clutch for drivingly connecting said spool shaft to said output shaft and including means normally biasing said clutch toward driving engagement, a clutch lever for moving said clutch to a disengaged position in opposition to said biasing means, and detent means for releasably retaining said clutch lever in a position corresponding to said disengaged position.

13. In a machine for processing a continuous strand of wire the combination comprising a frame, a pair of capstans supported for rotation on said frame for receiving portions of the strand looped therearound, means for driving said capstans in timed relation to each other, and a festoon assembly for accumulating and storing a portion of the strand and including a first set of sheaves supported on said frame for coaxial free rotation relative to each other about an axis parallel to the axes of said capstans and a second set of sheaves supported on said frame and journaled for coaxial free rotation relative to each other about an axis parallel to the axes of said capstans, one of said sets being supported for movement relative to said frame and toward and away from the other of said sets.

14. The combination as set forth in claim 13 wherein each of said capstans is generally cylindrical and has a series of coaxial annular wire receiving grooves opening through its peripheral surface.

15. The combination as set forth in claim 14 wherein each of said capstans has at least five wire receiving grooves therein.

* * * * *